US008266861B2

(12) United States Patent
Koch et al.

(10) Patent No.: US 8,266,861 B2
(45) Date of Patent: Sep. 18, 2012

(54) PROCESS OF PRODUCING HIP, RIDGE OR RAKE SHINGLES, AND HIGH PROFILE SHINGLES PRODUCED THEREBY

(75) Inventors: Stephen A. Koch, Collegeville, PA (US); Husnu M. Kalkanoglu, Swarthmore, PA (US); Joseph Quaranta, Yardley, PA (US)

(73) Assignee: CertainTeed Corporation, Valley Forge, PA (US)

( * ) Notice: Subject to any disclaimer, the term of this patent is extended or adjusted under 35 U.S.C. 154(b) by 59 days.

(21) Appl. No.: 12/619,822

(22) Filed: Nov. 17, 2009

(65) Prior Publication Data

US 2010/0192501 A1 Aug. 5, 2010

Related U.S. Application Data

(63) Continuation-in-part of application No. 12/364,842, filed on Feb. 3, 2009.

(51) Int. Cl.
*E04D 1/30* (2006.01)
*E04D 1/00* (2006.01)

(52) U.S. Cl. ..... 52/520; 52/DIG. 16; 52/57; 52/518

(58) Field of Classification Search ..... 52/DIG. 16, 52/518, 520, 543, 276, 557, 527, 57
See application file for complete search history.

(56) References Cited

U.S. PATENT DOCUMENTS

| | | | | |
|---|---|---|---|---|
| 1,108,884 | A | | 9/1914 | Bird |
| 1,153,418 | A | | 9/1915 | Bird |
| 1,184,509 | A | | 5/1916 | Bird |
| 1,185,509 | A | | 5/1916 | Bird |
| 2,230,922 | A | | 2/1941 | Young |
| 2,253,753 | A | | 8/1941 | Black |
| 3,913,294 | A | | 10/1975 | Freiborg |
| 3,919,823 | A | * | 11/1975 | Bradley ..... 52/557 |
| 4,295,445 | A | | 10/1981 | Kopenhaver |
| 4,404,783 | A | | 9/1983 | Freiborg |
| 4,439,955 | A | | 4/1984 | Freiborg |
| 4,835,929 | A | | 6/1989 | Bondoc et al. |
| 4,907,499 | A | | 3/1990 | James |
| 5,052,162 | A | | 10/1991 | Bush et al. |
| 5,054,254 | A | | 10/1991 | Sells |
| 5,095,810 | A | | 3/1992 | Robinson |
| 5,109,149 | A | | 4/1992 | Leung |
| 5,122,095 | A | | 6/1992 | Wolfert |
| 5,271,201 | A | | 12/1993 | Noone et al. |
| 5,295,340 | A | | 3/1994 | Collins |
| 5,319,898 | A | | 6/1994 | Freiborg |
| 5,419,941 | A | | 5/1995 | Noone et al. |
| 5,458,538 | A | | 10/1995 | MacLeod et al. |
| 5,471,801 | A | | 12/1995 | Kupczyk et al. |

(Continued)

FOREIGN PATENT DOCUMENTS

WO WO2009023038 A2 2/2009

*Primary Examiner* — Branon Painter
*Assistant Examiner* — Elizabeth A Plummer
(74) *Attorney, Agent, or Firm* — Paul & Paul

(57) ABSTRACT

A hip, ridge or rake shingle is provided, having a high profile, by using various shingle layers to form a built-up wedge-shaped headlap portion, comprised of a plurality of layers of different dimensions in the headlap portion of the shingle, and the process for manufacturing the same from a single sheet of shingle material is provided.

13 Claims, 6 Drawing Sheets

U.S. PATENT DOCUMENTS

| | | | | |
|---|---|---|---|---|
| D366,335 | S | 1/1996 | Noone et al. | |
| D366,336 | S | 1/1996 | Noone et al. | |
| 5,570,556 | A | 11/1996 | Wagner | |
| 5,711,126 | A | 1/1998 | Wells | |
| 5,772,502 | A | 6/1998 | Smith | |
| 5,916,103 | A | 6/1999 | Roberts | |
| 5,951,809 | A | 9/1999 | Jenkins et al. | |
| 5,956,913 | A | 9/1999 | Nicholson | |
| 6,182,400 | B1 | 2/2001 | Freiborg et al. | |
| 6,237,288 | B1 | 5/2001 | Jenkins et al. | |
| 6,351,913 | B1 | 3/2002 | Freiborg et al. | |
| 6,355,132 | B1 | 3/2002 | Becker et al. | |
| 6,418,692 | B1 | 7/2002 | Freshwater et al. | |
| 6,470,642 | B1 | 10/2002 | Eads | |
| 6,482,084 | B2 | 11/2002 | Hansen | |
| 6,494,010 | B1 | 12/2002 | Brandon et al. | |
| 6,530,189 | B2 | 3/2003 | Freshwater et al. | |
| 6,725,609 | B2 | 4/2004 | Freiborg et al. | |
| 6,874,289 | B2 | 4/2005 | Koch et al. | |
| 6,933,037 | B2 * | 8/2005 | McCumber et al. | 428/143 |
| 7,178,294 | B2 | 2/2007 | Jolitz | |
| 1,547,498 | A1 | 1/2010 | Jordan | |
| D633,222 | S * | 2/2011 | Koch et al. | D25/139 |
| 2002/0000068 | A1 | 1/2002 | Freiborg et al. | |
| 2002/0078651 | A1 | 6/2002 | Freshwater et al. | |
| 2003/0077999 | A1 | 4/2003 | Mankowski | |
| 2003/0196389 | A1 | 10/2003 | Naipawer, III | |
| 2004/0221536 | A1 | 11/2004 | Kalkanoglu et al. | |
| 2004/0237428 | A1 | 12/2004 | Headrick et al. | |
| 2005/0072092 | A1 | 4/2005 | Williams | |
| 2005/0193673 | A1 * | 9/2005 | Rodrigues et al. | 52/518 |
| 2005/0210806 | A1 | 9/2005 | Guerra | |
| 2006/0029775 | A1 | 2/2006 | MacKinnon et al. | |
| 2006/0292979 | A1 | 12/2006 | Stearns | |
| 2007/0144077 | A1 * | 6/2007 | Quaranta et al. | 52/43 |
| 2007/0251571 | A1 * | 11/2007 | Jacobs et al. | 136/256 |
| 2007/0266665 | A1 | 11/2007 | Todd et al. | |
| 2009/0038257 | A1 | 2/2009 | Todd et al. | |
| 2009/0173031 | A1 * | 7/2009 | Martinique et al. | 52/553 |

* cited by examiner

PROCESS OF PRODUCING HIP, RIDGE OR RAKE SHINGLES, AND HIGH PROFILE SHINGLES PRODUCED THEREBY

CROSS-REFERENCE TO RELATED APPLICATIONS

This is a continuation-in-part of U.S. patent application Ser. No. 12/364,842 filed Feb. 3, 2009, the complete disclosure of which is herein incorporated by reference.

BACKGROUND OF THE INVENTION

In the shingle art, it is known to cover hips, ridges, and rakes of a roof with shingles.

In the past, when a roof was being shingled with multiple-tab shingles, it was common to cut or tear a single tab of a multiple-tab shingle, severing the same from the rest of the shingle, and to then use that cut-away tab as a hip, ridge, or rake shingle.

However, as demand for different aesthetic effects became popular, wherein laminated shingles having different aesthetic effects became more popular, it became desirable to have the hip, ridge, or rake shingles be consistent with the same aesthetics as the shingles covering the rest of the roof. Such laminated shingles of the hip, ridge or rake type are shown for example in U.S. Pat. Des. 366,336; 4,835,929 and 6,494,010.

SUMMARY OF THE INVENTION

The present invention is directed to a hip, ridge or rake shingle and to a process for efficiently producing a plurality of hip, ridge or rake shingles wherein the shingles have a substantially thickened portion along an edge which is exposed in the installed condition of the shingles on a roof, to visually present a high profile for the shingles.

Accordingly, it is an object of this invention to provide a novel process for producing laminated hip, ridge or rake shingles.

It is another object of this invention to produce shingles and an array of shingles in accordance with the object above, wherein, optionally, a shadow line or band is provided, for ornamental effect on a tab portion of an anterior shingle layer.

It is yet another object of this invention to produce laminated hip, ridge, or rake shingles, that are adhered together in such a way that, as the laminated shingles are bent into the approximate shape of an inverted V, the shingle layers can have some relative movement, to facilitate a smooth bending operation.

Other objects and advantages of the present invention will be readily understood upon a reading of the following brief descriptions of the drawing figures, the detailed descriptions of the preferred embodiments, and the appended claims.

BRIEF DESCRIPTIONS OF THE DRAWING FIGURES

DETAILED DESCRIPTIONS OF THE PREFERRED EMBODIMENTS

Figure 1:
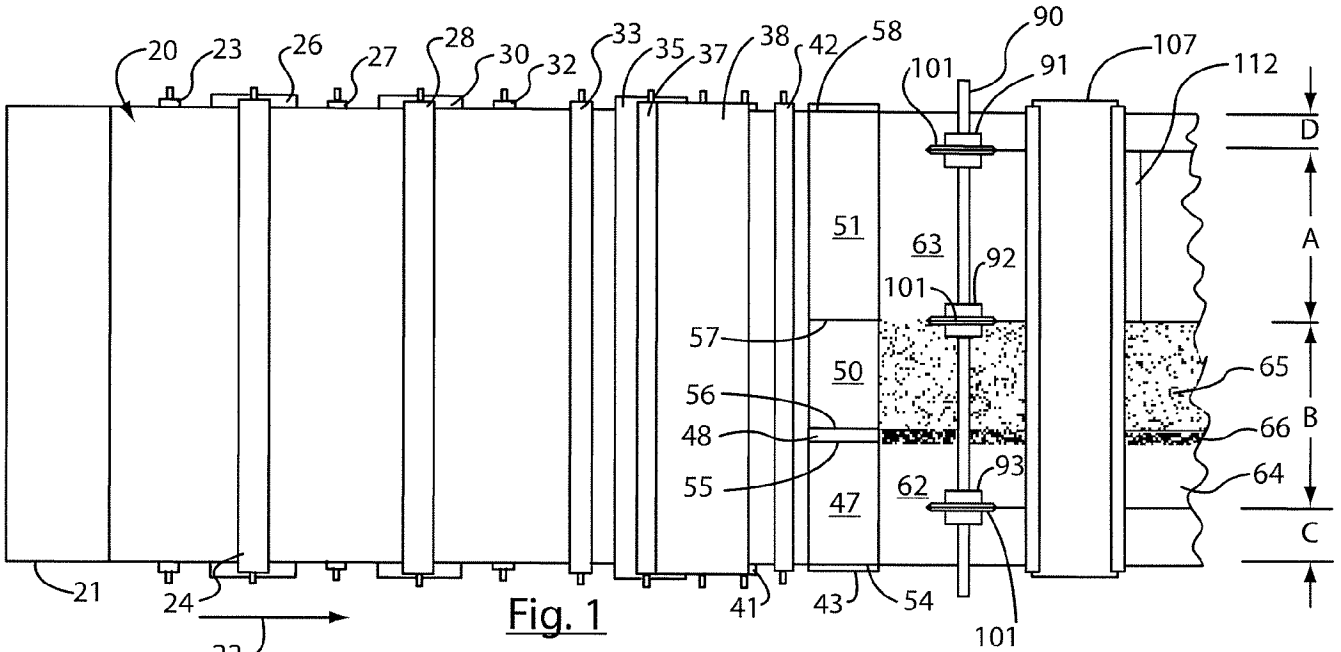
FIG. 1 is a schematic top plan view of a portion of the shingle process in accordance with this invention.
Figure 2:
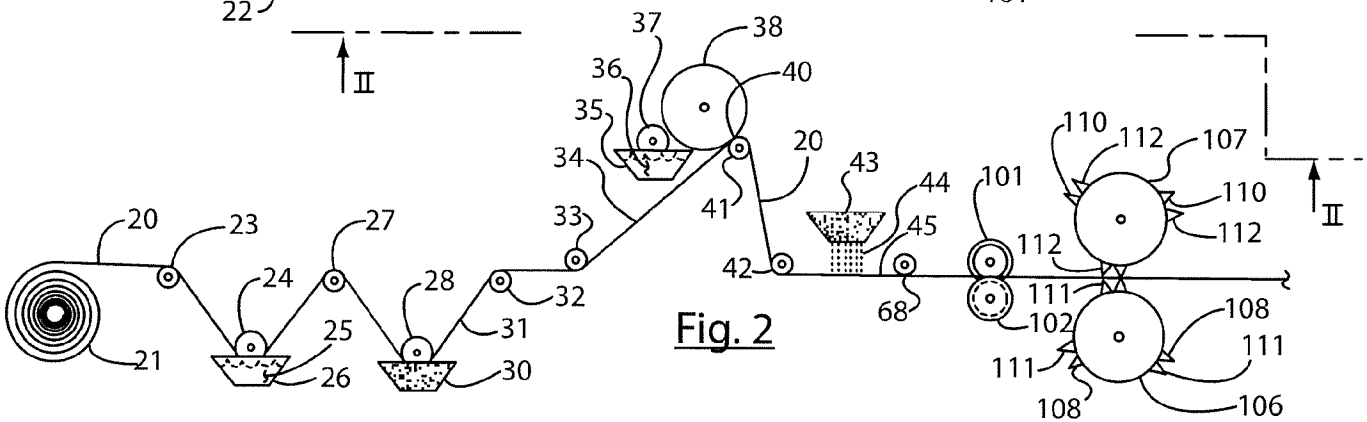
FIG. 2 is a schematic front elevational view of the portion of the shingle process illustrated in FIG. 1, taken fragmentally along the line II-II of FIG. 1.

Referring now to the drawings in detail, reference is first made to FIGS. 1 and 2. A sheet 20 comprising an indefinite length of fibrous material, such as organic or inorganic mat, is provided, which may or may not be provided in the form of a roll 21, and which is impregnated or will become impregnated with a preferably bituminous material such as asphalt. The mat 20, as it travels in its longitudinal path 22, may pass over a roller 23, to pass beneath another transverse roller 24 to impregnate at least the lower surface of the fibrous sheet 20 with an adhesive 25, that also will preferably be a bituminous material such as asphalt, from a transverse tank 26, with the fibrous sheet 20 then passing over another transverse roller 27, to be delivered beneath another roller 28, disposed in a particle application trough 30, or the like, for adherence of tiny granule particles such as sand, mica, or the like to the undersurface 31 of the fibrous sheet 20.

It will be understood that other techniques for applying an adhesive to the fibrous sheet 20 may be employed, such as by running the sheet 20 through a bath of adhesive, that, again, will preferably be of a bituminous material such as asphalt. Similarly, other techniques for applying tiny granules such as sand, mica or the like to the undersurface 31 of the fibrous sheet 20 may likewise be employed, as alternatives. As a further alternative, the tiny granules could be applied at a different time, for example, at a later time, as will be described hereinafter.

The fibrous sheet 20 may then pass over and under another series of rollers 32, 33, to a location where an adhesive such as asphalt or other bituminous material is applied to the top surface 34 of the sheet 20.

In the embodiment of FIGS. 1 and 2, such adhesive is applied from a transverse adhesive trough 35 by applying the adhesive 36 to a roller 37 arranged in the trough 35, which, in turn, applies the adhesive to another, larger roller 38, which applies the adhesive as the upper surface 34 as the fibrous sheet 20 passes through the nip 40 between the large roller 38 and another roller 41.

The thus impregnated sheet 20 then passes around another transverse roller 42 before traveling beneath a granule applicator 43, for deposit of granules 44 on an upper surface 45 of the sheet 20.

The granule applicator 43 is divided into four application zones 47, 48, 50, and 51 separated by walls 54, 55, 56, 57, and 58.

Granules from zones 47 and 51 are preferably post-industrial granules or lower cost or scrap granules or recycled granules and will generally be dark granules (not shown as such) and are deposited in wide longitudinal bands 62 and 63, shown at the right of FIG. 1, from between walls 54, 55 and 57, 58 of granule applicator 43. The bands 62, 63 of darker granules will thus be on the front surfaces of the shingle layers A, C, D, and portion 64 of layer B after longitudinal cutting and lamination of the anterior and posterior shingle layers together, as will be discussed hereinafter.

Granules from zone 50, between walls 56 and 57 will generally be lighter and/or colored granules, for visually aesthetic reasons and/or for resisting heat or radiation absorption. The granules from zone 50 are deposited in a longitudinal band 65, on a portion of the sheet 20 that will form a component of an anterior shingle layer.

Preferably dark granules will be deposited from zone 48 between walls 55 and 56, to form a longitudinal shadow band 66, if this option is desired.

Instead of dropping darker, shadow line granules from hopper section 48 at the same time that granules are dropped from hopper sections 47, 50 and 51, as an alternative, the band 65 of darker, shadow line granules could be made by providing such granules in the form of an overlay, by first placing a line or band of adhesive, and then subsequently dropping the darker granules to form the overlay, on top of granules like either of those dropped from granule applicator sections 47 or 50. In this regard, reference is made to FIG. 3, wherein an alternative overlay layer of adhesive and granules is illustrated.

Figure 2A:
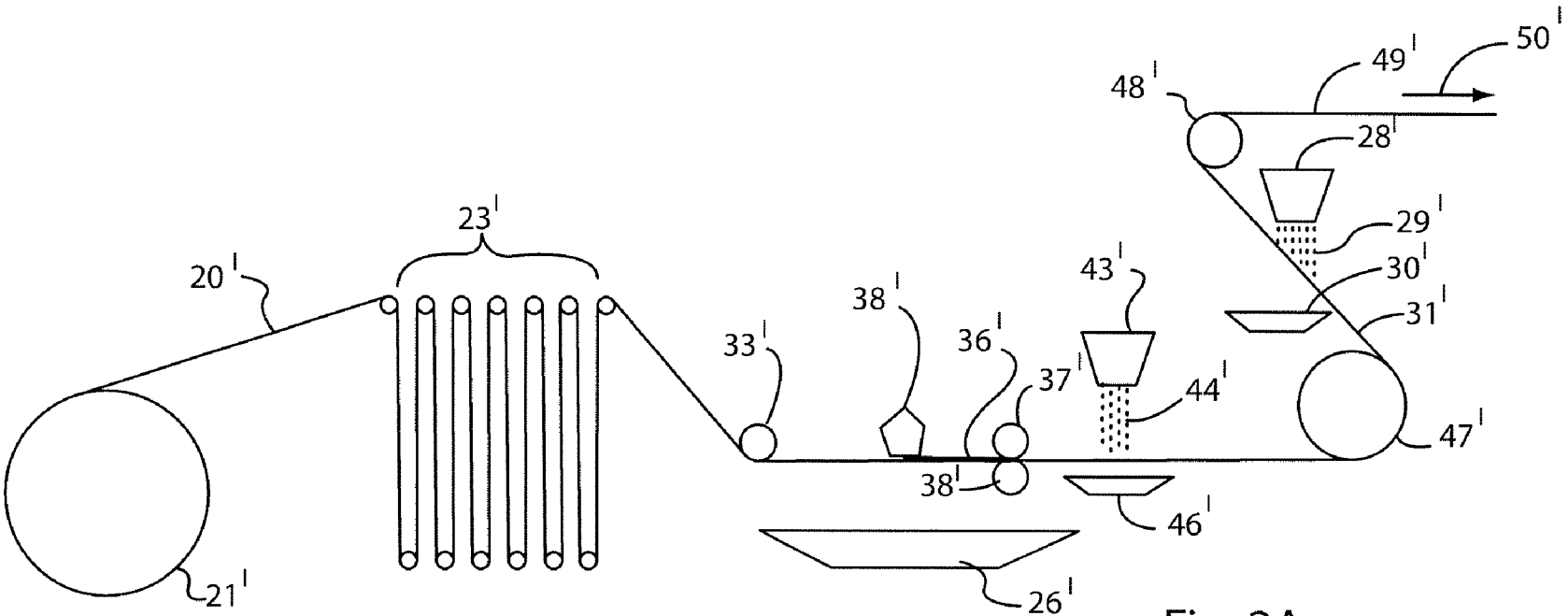
FIG. 2A is a schematic front elevational view of an alternative preferred portion of a shingle process, in which the particles of sand, mica or the like are applied to the back surface of the layer of shingle material later in the process than in FIG. 2.

With specific reference to FIG. 2A, it will be seen that a roll 21' of mat is provided, in which the mat 20' is unrolled, and passes through an accumulator 23', then around a roller 33', to then pass into a horizontal position beneath a coater 38' where bituminous material, preferably asphalt is applied to the mat 20' in the form of a layer 36' of bituminous material. A catch tray 26' is provided for receiving excess coating material being applied from the coater 38'. The mat with the bituminous coating 36' then passes beneath a pair of metering rollers 37', 38', in which the bituminous material is metered to a desired thickness, with the mat 20' then passing beneath a granule applicator 43', which dispenses granules 44' onto the coated mat, with a catch tray 46' disposed therebeneath for receiving excess granules 44'. The coated and granule-applied mat then passes around a roller 47', with a back surface applicator 28' dispensing finer particles, such as sand, mica or the like 29' onto the back surface 31' of the mat, with excess such particles being received in a catch tray 30', with the mat then passing around a roller 48', to be delivered in the direction of the arrow 50', as a mat 49', having granules applied to an upper surface and finer particles applied to a lower surface thereof.

Figure 3:
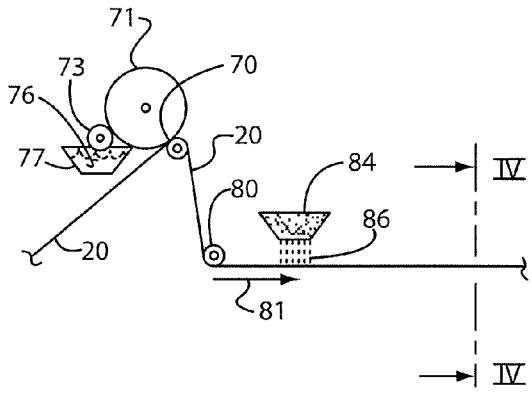
FIG. 3 is a schematic fragmentary front elevational view of an optional portion of an alternative shingle process, wherein a shadow line or band is provided via an overlay process.

In FIG. 3, the sheet 20, after having the various granules deposited thereon from granule applicator 43, except for the darker granules 65 deposited from granule applicator section 48, the sheet 20 will be delivered to nip 70 beneath adhesive applicator roller 71 to receive adhesive via rollers 73 and 71 from adhesive 76 in adhesive trough 77, to apply a continuous or discontinuous band of adhesive to the upper surface of the portion of the sheet 20 that will comprise the anterior surface of the weather-exposed shingle layer. The sheet 20 with the narrow band of adhesive applied via roller 71 then passes beneath roller 80 as the sheet 20 moves longitudinally rightward as shown in the direction of the arrow 81 in FIG. 3. The sheet 20 is thus delivered beneath overlay granule applicator 84 which deposits overlay granules, preferably dark in shading, onto the thin longitudinal band of adhesive that has been applied via adhesive applicator roller 71 as shown in FIG. 3.

However the shadow band of dark granules is applied, the sheet 20 then passes beneath the shaft 90 that carries rollers 91, 92 and 93 mounted thereon, that, in turn, carry upper and lower slitter blades 101 and 102, whereby the sheet 20 is slit into four sections A, B, C and D. One of the rollers, such as the roller 102, for example, could be an anvil roller, against which a blade 101 of a slitter roller operates, if desired.

The sheet 20 then passes between a pair of transverse cutter rollers 106 and 107, each shown as having three transverse cutters 108, 110 preferably disposed 120° apart around rollers 106, 107, with the rollers 106, 107 being sized to cut the sheet 20 transversally into predetermined sizes, whenever cutters 108, 110 meet each other, to cut the sheet into separate layers of desired size.

The rollers 106, 107 may thus have their blades 108, 110 arranged to cut the shingle layers A, B, C and D into desired selected widths, such as 8 inches, 10 inches, or 12 inches, so that they are all essentially the same size in width, as will be illustrated for example hereinafter with respect to FIG. 5.

The cutter rollers 106 and 107 also have cutters 111, 112 carried thereon, in pairs, for cutting the shingle layer A, to remove approximately a ¼ inch portion of the sheet layer A, so that its width-wise dimension is slightly less than the width-wise dimensions of the other sheet layers B, C and D. This reduced dimension will facilitate the sheet layers A and B having their opposite width-wise edges aligned together, when the resulting shingle is bent over a peak, or across other intersecting surfaces of a roof.

It will be apparent throughout the above-discussed figures, that the various rollers are all shaft-mounted, and that in many cases, the rollers will be positively driven via motors or the like. However, it will likewise be understood that in many cases some of the rollers that are not actually used to longitudinally move the sheet forward in the direction of the arrow 22, for example, can be idler rollers, rather than motor-driven rollers.

Further, while the rollers are shown for cutting purposes, other cutting means may be employed, such as, for example, stamping blades, water jets, laser cutters, and other cutting means known in the art.

Figure 4:
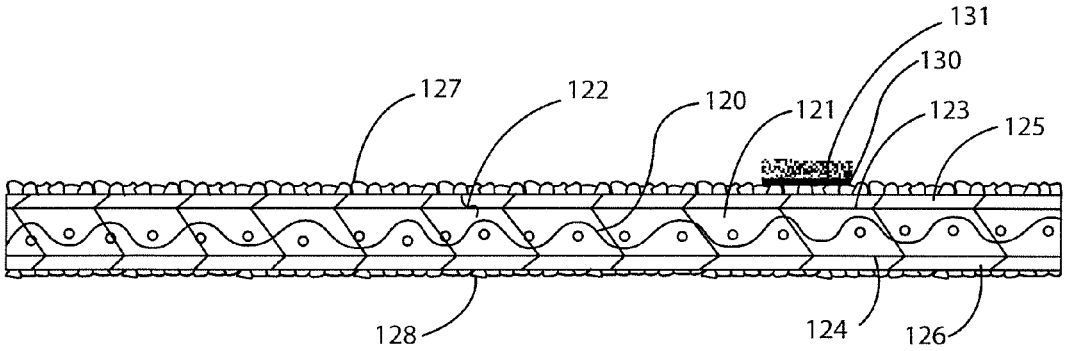
FIG. 4 is an enlarged fragmentary cross-sectional view of a layer of shingle material taken generally along the line of IV-IV of FIG. 3.

Referring now to FIG. 4, it will be seen that each shingle layer A-D described above is preferably comprised of a web 120 of organic or preferably inorganic material, such as fiberglass, that is impregnated with a bitumen material 121, such as asphalt, to yield an asphalt-impregnated web 122. Upper and lower surfaces 123, 124 of the asphalt impregnated web 122 have respective adhesive layers 125, 126 applied thereto, which adhesive layers 125, 126 can likewise be a bituminous material such as asphalt, and the outward facing surfaces of the adhesive layers 125, 126 have respective granule layer 127 and smaller particle layer 128 applied thereto. The smaller particles can, if desired, be sand, mica or the like. The granules 127, applied to the upper or outer surfaces of the shingle layers A-D can be comprised of ground slate, gravel, or any other substance that is desired, which will protect the underlying bituminous material from heat of the sun, ultraviolet rays, and the like.

If the shadow line or band of granules is applied in accordance with the embodiment of FIG. 3, above, the adhesive 76 will be in the form of an adhesive line or band 130, to which a line or band 131 of granules 86 are applied, to form an overlay of granular material that comprises the shadow line or band.

Figure 5:
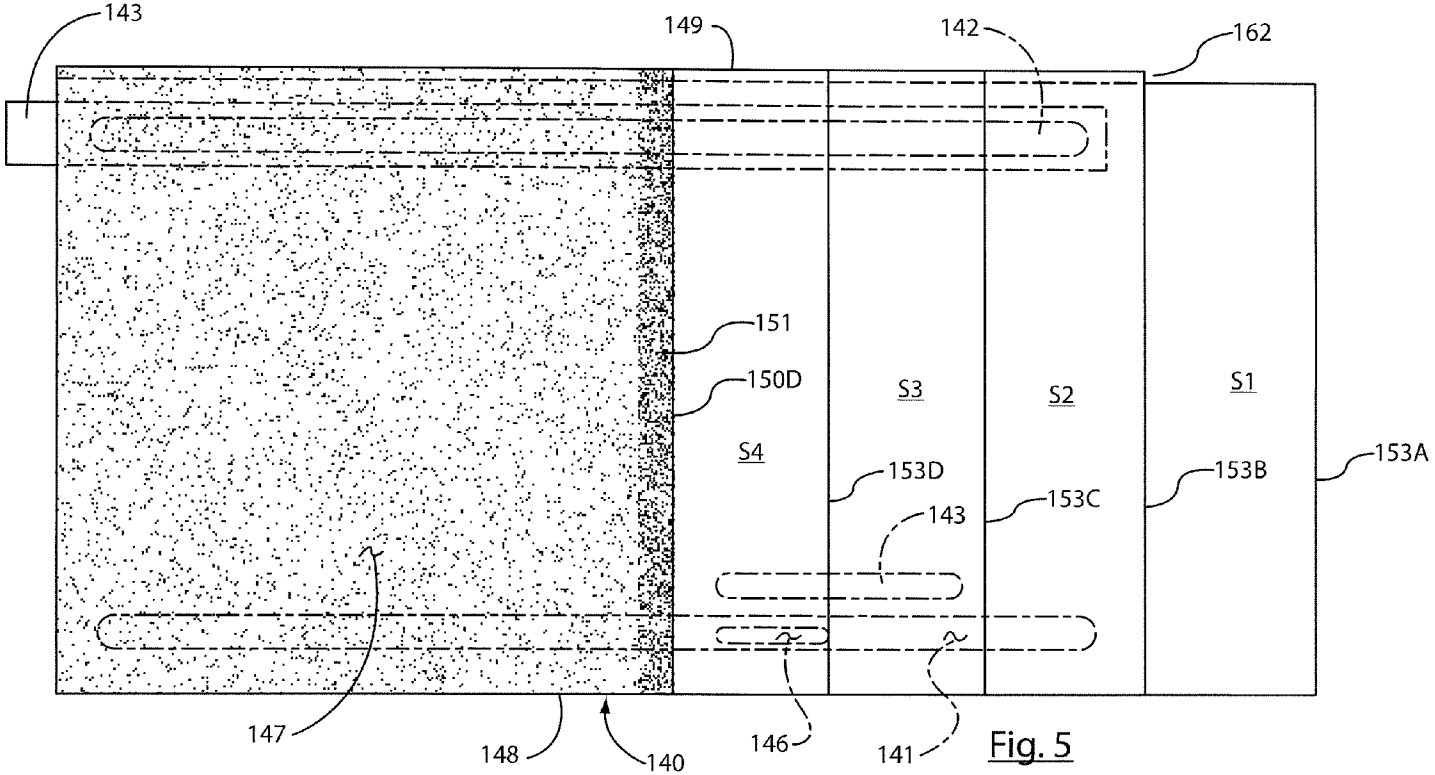
FIG. 5 is a top plan view of a four-layer shingle in accordance with this invention, with zones of adhesion between the shingle layers being illustrated in broken lines, and wherein a removable release strip is provided near one edge of the shingle, and between the two lowermost layers of shingle material.
Figure 6:
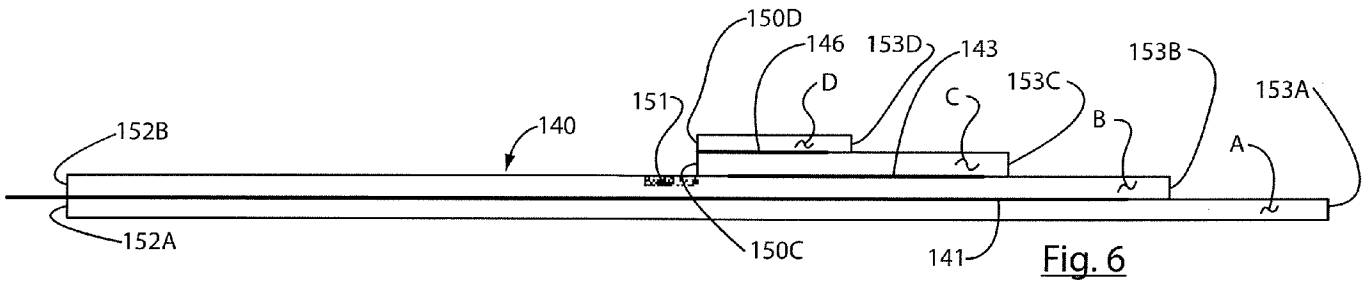
FIG. 6 is a front elevational view of the built-up shingle of FIG. 5.

Referring now to FIGS. 5 and 6, it will be seen that the hip, ridge or rake shingle 140 of this invention is provided, in which the lowermost layer A comprises the posterior layer and is the longest, from left to right as illustrated in FIG. 6, and may be of 16 inches between its leading and trailing edges 152A and 153A, respectively, especially if the sheet 20 of material from which the layers cut is of 36 inches in width.

The next layer B, comprises the anterior layer, and, in the case of a sheet 20 with a width of 36 inches, would be 14 inches from left to right between its leading and trailing edges 152B and 153B, respectively, and is adhered to the layer A by an elongate layer 141 of adhesive inside its side edge 148, to comprise a laminate of layers A and B. At the opposite edge 149, at the top of the illustration of FIG. 5, there is another layer of adhesive 142, adhered to the top surface of layer A, but not adhered to next adjacent layer B, because of the presence of a layer of removable release strip 143, covering the adhesive 142, but removable from between the layers A and B prior to installation of the hip, ridge or rake shingle 140 on a roof. The release strip 143 will enable relative sliding motion between the layers A and B as the shingle 140 is bent to be applied over intersecting surfaces of a roof, as will be shown hereinafter with respect to FIG. 7.

Layer C comprises a first riser and will preferably be of approximately 4 inches from left to right, between its leading and trailing edges 150C and 153C, respectively, assuming that the elongate sheet of shingle material 20 is 36 inches across the machine of FIG. 1, and will be adhered to layer B by a strip of adhesive 143, as shown in FIGS. 5 and 6. Layer D comprises a second riser and preferably would be approximately 2 inches from left to right as shown in FIG. 6, between its leading and trailing edges 150D and 153D, respectively, and will be adhered to layer C, also along one side of the shingle 140, as shown in FIG. 5, by a spot of adhesive 146. The opposed sides of shingle layers C and D will not normally be adhered to their underlying shingle layers, so that there can be relative sliding movement between them, as the shingles are bent over intersecting roof surfaces, as is shown in FIG. 7.

In FIGS. 5 and 6, the exposed-when-installed surface portion 147 of layer B will normally be 8 inches between its edge 152B and the stacked leading edges 150C and 150D, and the shadow line or band 151 will likewise be in the exposed portion 147, leftward of the edges 150C and 150D of stacked first and second risers C and D, respectively, as shown in FIGS. 5 and 6. The portion of the shingle 140 between leading edges 152A and 152B and stacked edges 150C and 150D comprises the tab portion of the shingle 140 and the portion of the shingle between stacked edges 150C and 150D and trailing edge 153A comprises the butt or headlap portion of the shingle 140. The tab portion of the shingle 140 is uncovered when installed on a roof and the surface portion 147 is weather-exposed, whereas the butt or headlap portion of the shingle 140 underlies and is covered by a tab portion of a next-overlying shingle when installed on a roof.

Figure 7:
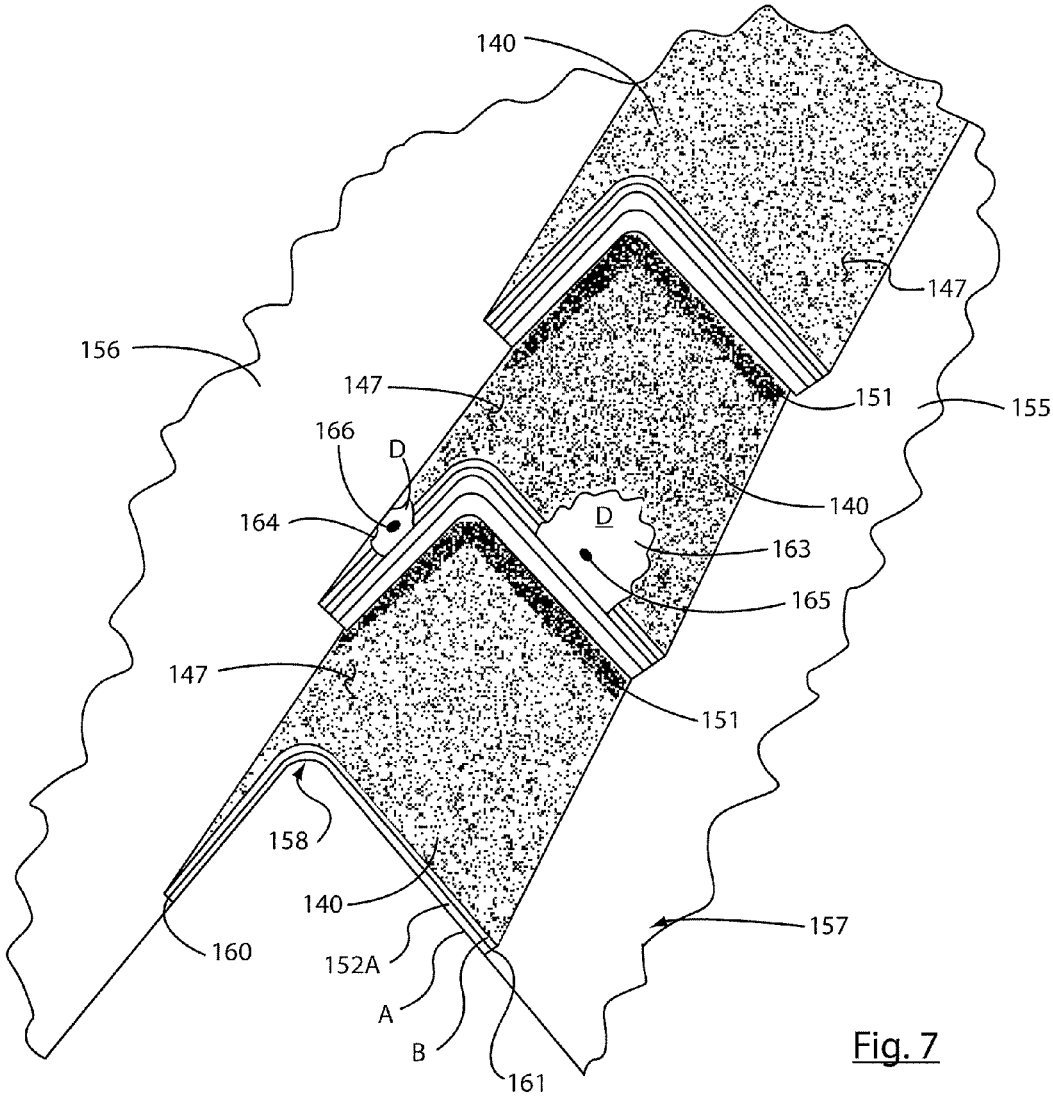
FIG. 7 is a fragmentary top perspective view of an array of hip, ridge or rake shingles in accordance with this invention, as they would appear in the installed condition on a roof.
Figure 8:
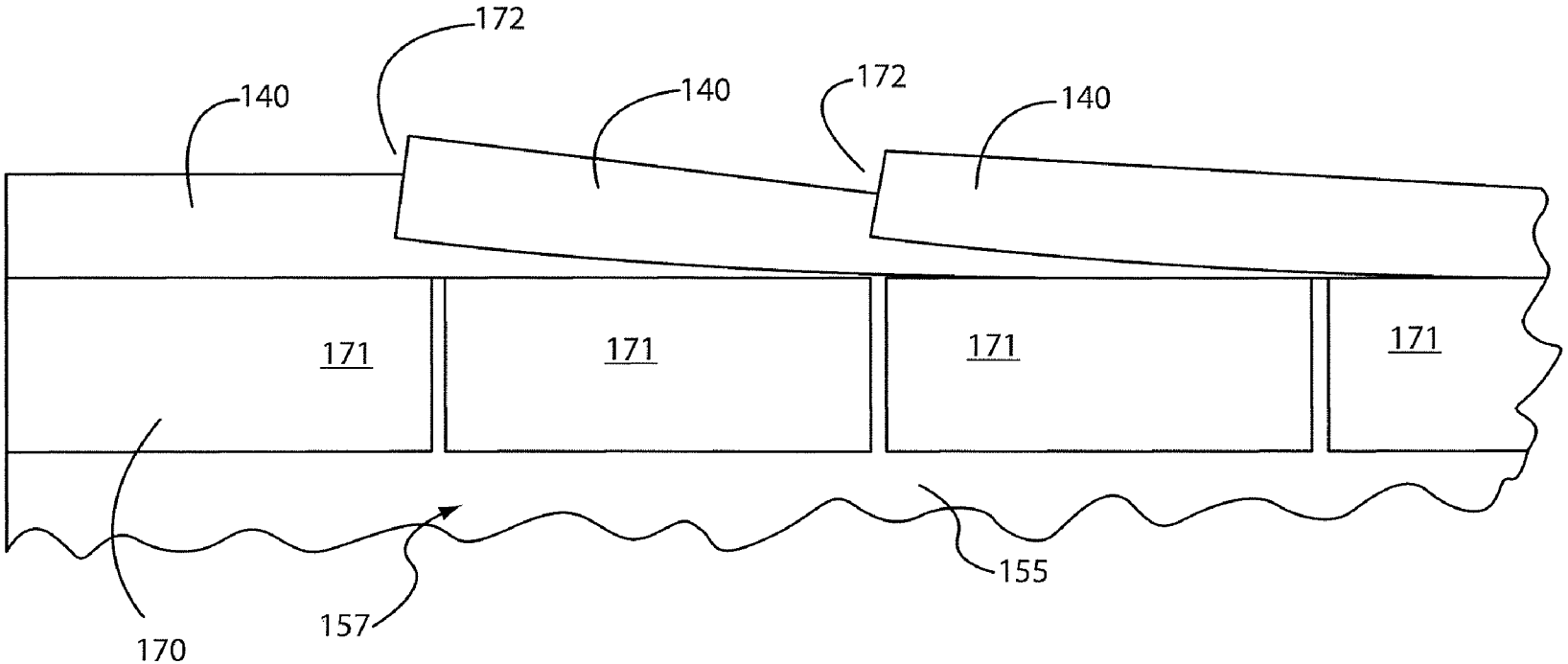
FIG. 8 is a right side elevational view of the high profile shingles illustrated in FIG. 7 applied to an apex of a roof, fragmentally illustrated, covering the upper ends of a field shingle also applied to the roof.

With particular reference to FIG. 5, it will therefore be seen that there is an area S1 at the right end of layer A, between trailing edges 153A and 153B that comprise a first step S1, and that a second step S2 is present on anterior layer B, at the right end thereof, between trailing edges 153B and 153C, and that a third step S3 is present on first riser C between trailing edges 153C and 153D, and that there is a fourth step S4 on second riser D between its trailing edge 153D and its leading edge 150D, such that the four steps S1, S2, S3 and S4 provide a progressive, decreasing stepped wedge-like thickness of the butt portion of the shingle 140, for receiving a tab portion of a next-overlying shingle thereover, as is illustrated in FIGS. 7 and 8. It will also be noted that the leading edges 150C and 150D of respective risers C and D are at the junction of the butt and tab portions of the shingle 140, with the butt portion of the shingle 140 being to the right of the stacked edges 150C and 150D, and with the tab portion of the shingle being to the left of the stacked edges 150C and 150D, as shown in FIG. 6. If desired, edge 152A of posterior layer A may extend leftward of edge 152B of anterior shingle layer to provide an ornamental "petticoat" effect, (not shown) and may also be provided with darker or colored granules for a shadow line effect or other decorative effect.

In FIG. 7 there are fragmentally illustrated two intersecting surfaces 155 and 156 of a roof 157. At the apex 158 of those intersecting surfaces 155, 156, there are shown three hip, ridge or rake shingles 140 applied thereover, bent over the intersecting surfaces.

It will be seen that, because one side of the adjacent layers A and B was not adhesively connected, such enables those layers to slide relative to each other, so that, when they are bent as shown in FIG. 7, their opposite edges 160, 161 will be more or less aligned, because of the shortening by ¼ inch, more or less of the lower layer A as described above by operation of the cutters 111, 112, which shortens layer A in its flat condition illustrated in FIG. 5, such shortening being illustrated by the numeral 162 in FIG. 5.

With reference to FIG. 7 it will also be seen that the optional shadow lines or bands 151 are visible at the upper ends of the exposed shingle portions 147, adjacent where a next-overlying shingles are applied. In FIG. 7, the broken-away portions 163, 164 of one of the shingles 140 illustrates where a placement of nails 165, 166, through a shingle layer D, may take place, fastening all shingle layers D, C, B and A to the roof 157, but wherein next-overlying tab portions of the shingle layers will cover those nails 165, 166, when shingle layers D are covered by each next-overlying shingle. Optionally, a sealant strip (not shown) may be added to the lower surface of layer A near the leading edge 152A to assist in sealing an overlying shingle to the shingle below (the next-underlying shingle).

In FIG. 8, there is illustrated an elevational view of the array of shingles shown in FIG. 7, as applied to a roof, after the application of a field shingle 170 is applied, as shown, to intersecting surface 155 of roof 157.

Overlying the headlap portions (unshown) of the shingles 170, and above the major portions of the tabs 171 of the shingle 170, there are applied a plurality of hip, ridge or rake shingles 140, as they would appear for example, on the apex of a roof 157, to have a high profile as can be seen at 172, giving a wedge-shaped appearance due to the placement of a next-overlying hip, ridge or rake shingle over a next-underlying hip, ridge or rake shingle, having the next-overlying tab portion of such shingle, overlying headlap portions of a next-underlying shingle, covering shingle layers D and C, and covering headlap portions of shingle layers B and A, as shown.

It will be appreciated from the foregoing that various modifications may be made in the details of the process of shingle manufacture in accordance with this invention, as well as in the details of construction of the shingles themselves, all within the spirit and scope of the invention, as defined in the appended claims.

What is claimed is:

1. A high profile hip, ridge or rake shingle having a tab portion and a butt portion, with the tab portion and the butt portion meeting at a junction, the shingle comprising:

(a) a posterior shingle layer of a first length and having a leading edge and a trailing edge;

(b) an anterior shingle layer of a second length, shorter than said first length, adhesively secured to said posterior layer and having a leading edge and a trailing edge, with the trailing edge of the anterior layer being spaced from the trailing edge of the posterior layer, leaving a first step on the posterior layer uncovered by said anterior layer;

(c) a first riser being of a third length and adhesively secured to said anterior layer and having a leading edge and a trailing edge, with its leading edge being at the junction of the shingle butt and tab portions and with its trailing edge being spaced from the trailing edge of the anterior layer, leaving a second step on the anterior layer uncovered by the first riser;

(d) a second riser being of a fourth length and adhesively secured to said first riser and having a leading edge and a trailing edge, with its leading edge being at the junction of the shingle butt and tab portions and its trailing edge being spaced from the trailing edge of the first riser, leaving a third step on the first riser uncovered by said second riser and with a top surface of the second riser comprising a fourth step;

(e) with said first, second, third and fourth uncovered steps, each being of sufficient and substantially equal length that, together, they comprise a progressive, decreasing substantially uniformly stepped wedge-like thickness of the butt portion of the shingle, that comprises means for receiving a tab portion of a next-overlying shingle thereover, in covering relation to said first, second, third and fourth steps.

2. The shingle of claim 1, wherein each said layer is comprised of an adhesive impregnated mat with upper and lower surfaces, and with granules on upper surfaces of the posterior and anterior layers and on the upper surface of the first riser being sandwiched between the shingle layers.

3. An array of shingles according to claim 2, laid up on a roof across intersecting surfaces of the roof, wherein the array comprises a plurality of underlying and overlying said shingles, with overlying shingles having their tab portions overlying butt portions of next-underlying shingles, covering said first, second, third and fourth steps.

4. The shingle of claim 1, including a line of adhesive between the posterior layer and the anterior layer, connected to only one of the surfaces of said anterior and posterior layers, and with a removable release strip between the line of adhesive and a surface of one of the anterior and posterior layers, to allow sliding movement between the anterior and posterior layers when the shingle is bent about an imaginary line generally parallel to said release strip.

5. The shingle of claim 1, wherein a shadow band of dark granules is provided on the anterior layer on the tab portion of the shingle adjacent to the junction between the tab portion and the butt portion of the shingle.

6. The shingle of claim 5, wherein said shadow bands is comprised of an overlay of a band of adhesive covered by overlay granules.

7. The shingle of claim 1, wherein the shingle is of a length as measured between its leading and trailing edges, of approximately 16 inches, and is of a width between side edges that is any of:

(a) 8 inches;

(b) 10 inches; and (c) 12 inches.

8. The shingle of claim 7, wherein the tab portion of the upper surface of the anterior layer is uncovered between its leading edge and the junction of the tab portion and the butt portion of the shingles.

9. An array of shingles according to claim 7, laid up on a roof across intersecting surfaces of the roof, wherein the array comprises a plurality of underlying and overlying said shingles, with overlying shingles having their tab portions overlying butt portions of next-underlying shingles, covering said first, second, third and fourth steps.

10. An array of shingles according to claim 1, laid up on a roof across intersecting surfaces of the roof, wherein the array comprises a plurality of underlying and overlying said shingles, with overlying shingles having their tab portions overlying butt portions of next-underlying shingles, covering said first, second, third and fourth steps.

11. The shingle of claim 1, wherein the first riser is approximately twice the length of the second riser.

12. A high profile hip, ridge or rake shingle having a tab portion and a butt portion, with the tab portion and the butt portion meeting at a junction, the shingle comprising:

(a) a posterior shingle layer of a first length and having a leading edge and a trailing edge;

(b) an anterior shingle layer of a second length, shorter than said first length, adhesively secured to said posterior layer and having a leading edge and a trailing edge, with the trailing edge of the anterior layer being spaced from the trailing edge of the posterior layer, leaving a first step on the posterior layer uncovered by said anterior layer;

(c) a first riser being of a third length and adhesively secured to said anterior layer and having a leading edge and a trailing edge, with its leading edge being at the junction of the shingle butt and tab portions and with its trailing edge being spaced from the trailing edge of the anterior layer, leaving a second step on the anterior layer uncovered by the first riser;

(d) a second riser being of a fourth length and adhesively secured to said first riser and having a leading edge and a trailing edge, with its leading edge being at the junction of the shingle butt and tab portions and its trailing edge being spaced from the trailing edge of the first riser, leaving a third step on the first riser uncovered by said second riser and with a top surface of the second riser comprising a fourth step;

(e) with said first, second, third and fourth steps together, comprising a progressive, decreasing stepped wedge-like thickness of the butt portion of the shingle, for receiving a tab portion of a next-overlying shingle thereover, wherein the posterior shingle layer has a first width and the anterior shingle layer has a second width, said first width being less than the second width.

13. A high profile hip, ridge or rake shingle having a tab portion and a butt portion, with the tab portion and the butt portion meeting at a junction, the shingle comprising:

(a) a posterior shingle layer of a first length and having a leading edge and a trailing edge;

(b) an anterior shingle layer of a second length, shorter than said first length, adhesively secured to said posterior layer and having a leading edge and a trailing edge, with the trailing edge of the anterior layer being spaced from the trailing edge of the posterior layer, leaving a first step on the posterior layer uncovered by said anterior layer;

(c) a first riser being of a third length and adhesively secured to said anterior layer and having a leading edge and a trailing edge, with its leading edge being at the junction of the shingle butt and tab portions and with its trailing edge being spaced from the trailing edge of the anterior layer, leaving a second step on the anterior layer uncovered by the first riser;

(d) a second riser being of a fourth length and adhesively secured to said first riser and having a leading edge and a trailing edge, with its leading edge being at the junction of the shingle butt and tab portions and its trailing edge being spaced from the trailing edge of the first riser, leaving a third step on the first riser uncovered by said second riser and with a top surface of the second riser comprising a fourth step;

(e) with said first, second, third and fourth steps together, comprising a progressive, decreasing stepped wedge-like thickness of the butt portion of the shingle, for receiving a tab portion of a next-overlying shingle thereover, including a line of adhesive between the posterior layer and the anterior layer, connected to only one of the surfaces of said anterior and posterior layers, and with a removable release strip between the line of adhesive and a surface of one of the anterior and posterior layers, to allow sliding movement between the anterior and posterior layers when the shingle is bent about an imaginary line generally parallel to said release strip wherein the posterior shingle layer has a first width and the anterior shingle layer has a second width, said first width being less than the second width.

* * * * *